US011034000B2

(12) United States Patent
Molburg

(10) Patent No.: US 11,034,000 B2
(45) Date of Patent: Jun. 15, 2021

(54) FRAME BLOCK CLAMP

(71) Applicant: John C. Molburg, Valparaiso, IN (US)

(72) Inventor: John C. Molburg, Valparaiso, IN (US)

( * ) Notice: Subject to any disclaimer, the term of this patent is extended or adjusted under 35 U.S.C. 154(b) by 373 days.

(21) Appl. No.: 16/169,704

(22) Filed: Oct. 24, 2018

(65) Prior Publication Data

US 2019/0126439 A1 May 2, 2019

Related U.S. Application Data

(60) Provisional application No. 62/578,013, filed on Oct. 27, 2017.

(51) Int. Cl.

| | |
|---|---|
| ***B25B 5/14*** | (2006.01) |
| ***B25B 1/20*** | (2006.01) |
| ***B25B 5/06*** | (2006.01) |
| ***B25B 5/16*** | (2006.01) |
| ***B25B 1/24*** | (2006.01) |

(52) U.S. Cl.

CPC ..... *B25B 5/147* (2013.01); *B25B 1/20* (2013.01); *B25B 1/2457* (2013.01); *B25B 5/06* (2013.01); *B25B 5/163* (2013.01)

(58) Field of Classification Search

CPC ..... B25B 1/20; B25B 1/2442; B25B 1/2457; B25B 5/06; B25B 5/147; B25B 5/163

See application file for complete search history.

(56) References Cited

U.S. PATENT DOCUMENTS

| | | | | |
|---|---|---|---|---|
| 365,755 | A * | 6/1887 | Moore | A41B 3/08 24/564 |
| 2,466,284 | A * | 4/1949 | Stinne | D06F 55/00 24/501 |
| 2,485,602 | A * | 10/1949 | Hovannessian | D06F 55/02 24/564 |
| 4,597,690 | A * | 7/1986 | Girard | F16L 3/243 403/391 |
| 5,794,897 | A * | 8/1998 | Jobin | H02G 7/053 24/459 |
| 7,000,609 | B2 * | 2/2006 | Kleen | A61M 16/0875 128/202.27 |
| 9,155,562 | B2 * | 10/2015 | Cremer | A61B 17/6466 |
| 2007/0014628 | A1 * | 1/2007 | Klippel | F16B 2/12 403/321 |
| 2013/0186500 | A1 * | 7/2013 | Chen | B25B 27/0035 138/89 |
| 2016/0082572 | A1 * | 3/2016 | Rattunde | B25B 1/2478 269/43 |

* cited by examiner

*Primary Examiner* — Ryan A Reis
(74) *Attorney, Agent, or Firm* — Donald G Flaynik

(57) ABSTRACT

A frame block clamp includes first and second block portions dimensioned and configured to provide first and second tube receiving apertures for snugly receiving a predetermined tube; and to provide first and second "V" configured recesses in respective first and second side portions when portions of said first and second block portions are cooperatively engaged. The frame block clamp further includes a retaining spring dimensioned and disposed to urge together predetermined portions of the first and second block portions to ultimately secure a tube in the first or second receiving apertures. The frame block clamp is ultimately secured in a vise to allow a person to service the tube secured in the first or second receiving aperture.

14 Claims, 12 Drawing Sheets

FRAME BLOCK CLAMP

This Utility patent application is based on Provisional Patent Application No. 62/578,013 filed on Oct. 27, 2017.

BACKGROUND OF THE INVENTION

1. Field of the Invention

The present invention relates to a frame block clamp to secure a portion of a frame (generally, a cylindrically configured member of the frame such as a tube) in one or more receiving apertures extending through the clamp. The frame block clamp with the tubular frame member secured in the clamp is ultimately secured in a vise, workbench or similar workpiece holding structure to allow a person to service or otherwise perform work on the tube.

2. Background of the Prior Art

A myriad of clamp sizes and configurations are commercially available. These clamps address a multitude of applications for personal use. However, most clamps are dimensionally adjustable so that the clamps can be used for multiple projects. There are prior art clamps that secure a tubular member in a vice; however, such prior art clamps are difficult to use because they must be manually held closed about the tubular member while the combination of the clamp and tubular member are aligned with and secured in a vise, thereby enabling a person to perform work upon a tubular member.

In addition, prior art clamps are made from wooden cubes intended to hold a single tube size. The relatively "short" dimensions of the cube make it difficult to secure the combined wooden cube and tube member in a vise, risking damage to the tube member if the tube member engages the vise jaws or if the tube member slides relative to the clamp portions engaging the tube member.
slides.

There is a need for a rectangular configured block clamp having relatively larger longitudinal dimension that allows two or more axially parallel apertures to be machined in the rectangular configured block clamp to receive two or more tube members varying in diameter. Further, the larger longitudinal dimension promotes the insertion of the clamp-tube member assembly into a vise.

There is a need for a frame block clamp that substantially engages the periphery of a tube member or similar structure to secure the structure to the clamp without damaging the structure; a clamp that engages and is secured to the structure via a biasing member such as a spring; a clamp that is operated by one hand of a user squeezing together predetermined portions of the clamp while the other hand of the user holds and positions the structure such that portions of the clamp ultimately engages substantially all of the corresponding periphery of the structure; and a clamp that enables the user to insert a predetermined side portion of the clamp in a vise to allow the user to perform work upon the structure without the user having to hold the structure.

SUMMARY OF THE INVENTION

It is an object of the present invention to overcome many of the disadvantages associated with prior art frame block clamps. A principal object of the present invention is to provide a frame block clamp for securing a structure to a vise to allow a user to perform work upon the structure. A feature of the clamp is two block portions having substantially similar configurations and dimensions, each block portion having at least one groove (and preferably two grooves) machined into inner portions of each block. An advantage of the clamp is that when the two block portions are joined together, one or more structure receiving apertures are formed that snugly receive a peripheral portion of the structure such that the clamp is able to secure the structure to the clamp, thereby maintaining the position of the structure when a side portion of the clamp is inserted and secured in a vise to allow a user to perform work on the structure.

Another object of the present invention is to provide a frame block clamp that can be manually operated by one hand of a user. A feature of the clamp is a retaining spring having opposite ends secured to respective top and bottom portions of the two block portions of the clamp. Another feature of the clamp is a recess in each of the side portions of the clamp. An advantage of the clamp is that with one hand, a user can squeeze together cooperating portions of either side portion of the clamp to separate the two block portions at an opposite side portion of the clamp, thereby allowing a structure held by the user's opposite hand to be inserted into a cooperating receiving aperture that snugly and peripherally receives a predetermined portion of the structure requiring manual labor. Another advantage of the clamp is that the retaining spring, which forcibly secures the two block portions of the clamp together, is sufficiently biased such that when a user releases a squeezed side portion of the clamp, the retaining spring urges the two block portions together until the two block portions peripherally seize the structure.

Yet another object of the present invention is to provide a frame block clamp having a relatively large longitudinal dimension, when compared to the remaining dimensions of the clamp, the longitudinal dimension promoting the insertion of the clamp holding a tube into a vise without damaging the tube. A feature of the clamp is a fulcrum disposed adjacent to each recess in each side portion of the clamp. An advantage of the clamp's longitudinal dimension is that either side portion of the clamp can be inserted into a vise such that the vise engages top and bottom walls of the clamp at portions longitudinally proximate to a respective fulcrum, thereby lineally aligning each "jaw" of the vise with the respective fulcrum and avoiding damage to the tube or similar structure "held" by the clamp. Another advantage of the clamp is that the engaged top and bottom wall portions of the clamp by the vise jaws allows the vise to grasp the clamp such that the corresponding side portion of the clamp cannot pivot or otherwise move, thereby maintaining the position of the clamp and the structure secured to the clamp when the jaws of the vise engage the clamp.

BRIEF DESCRIPTION OF THE DRAWINGS

The foregoing invention and its advantages may be readily appreciated from the following detailed description of the preferred embodiment, when read in conjunction with the accompanying drawings in which.

DESCRIPTION OF THE PREFERRED EMBODIMENT

Figure 1:
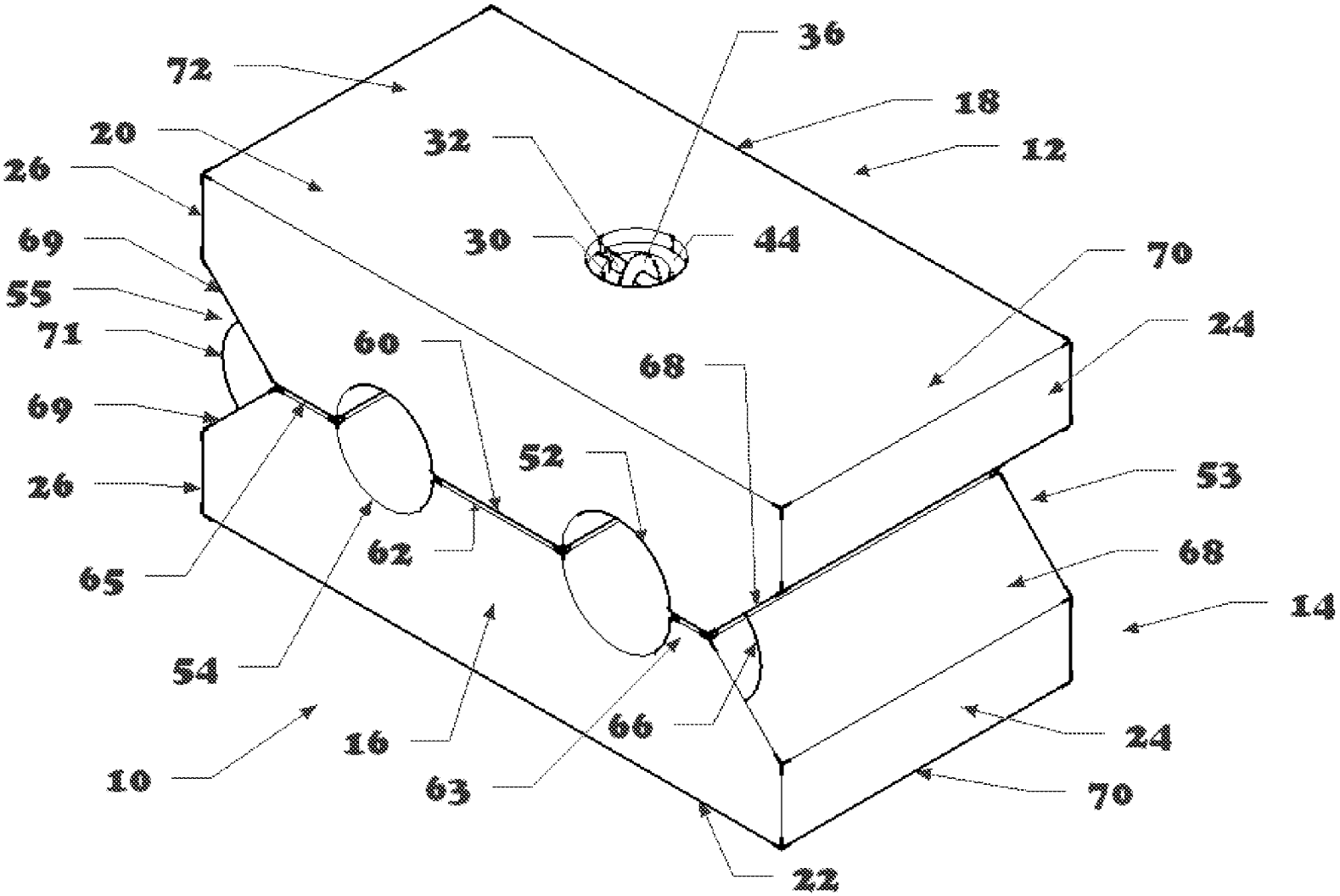
FIG. 1 is a front-top perspective view of a frame block clamp in accordance with the present invention.
Figure 2:
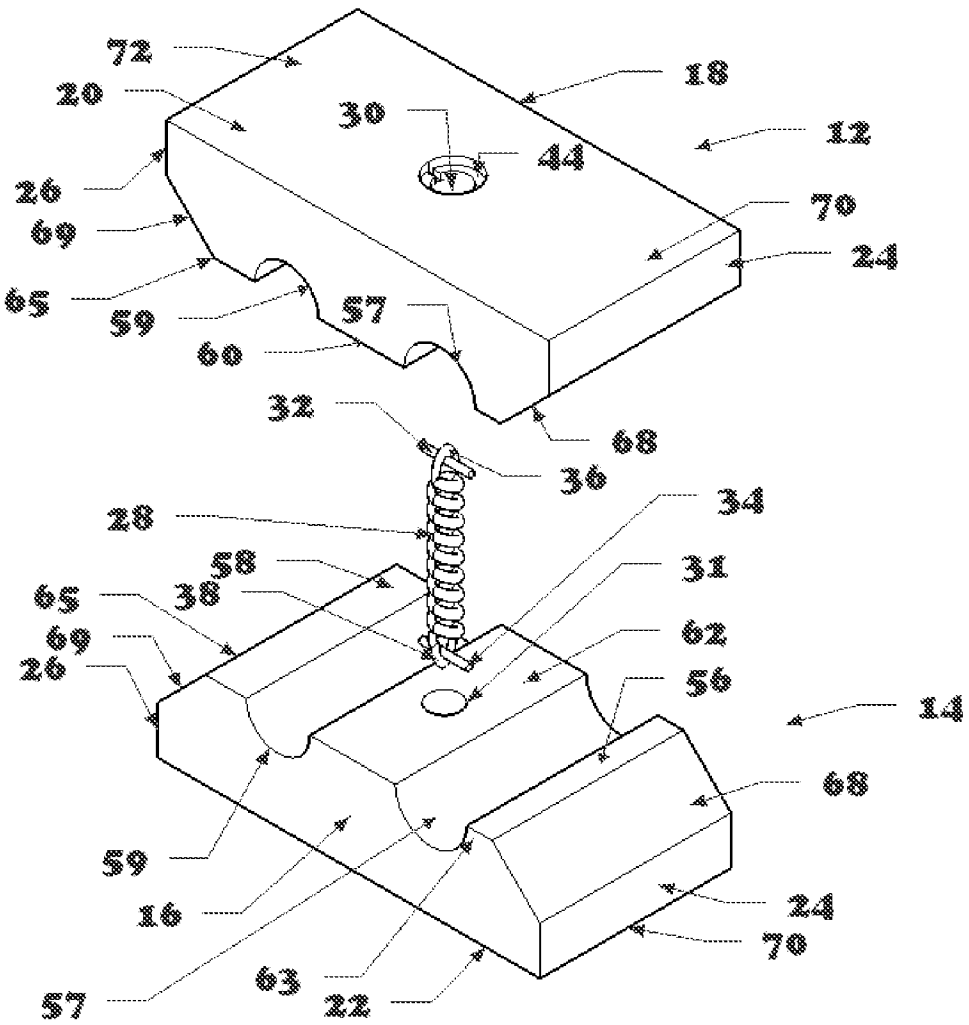
FIG. 2 is an exploded view of the frame block clamp of FIG. 1.
Figure 3:
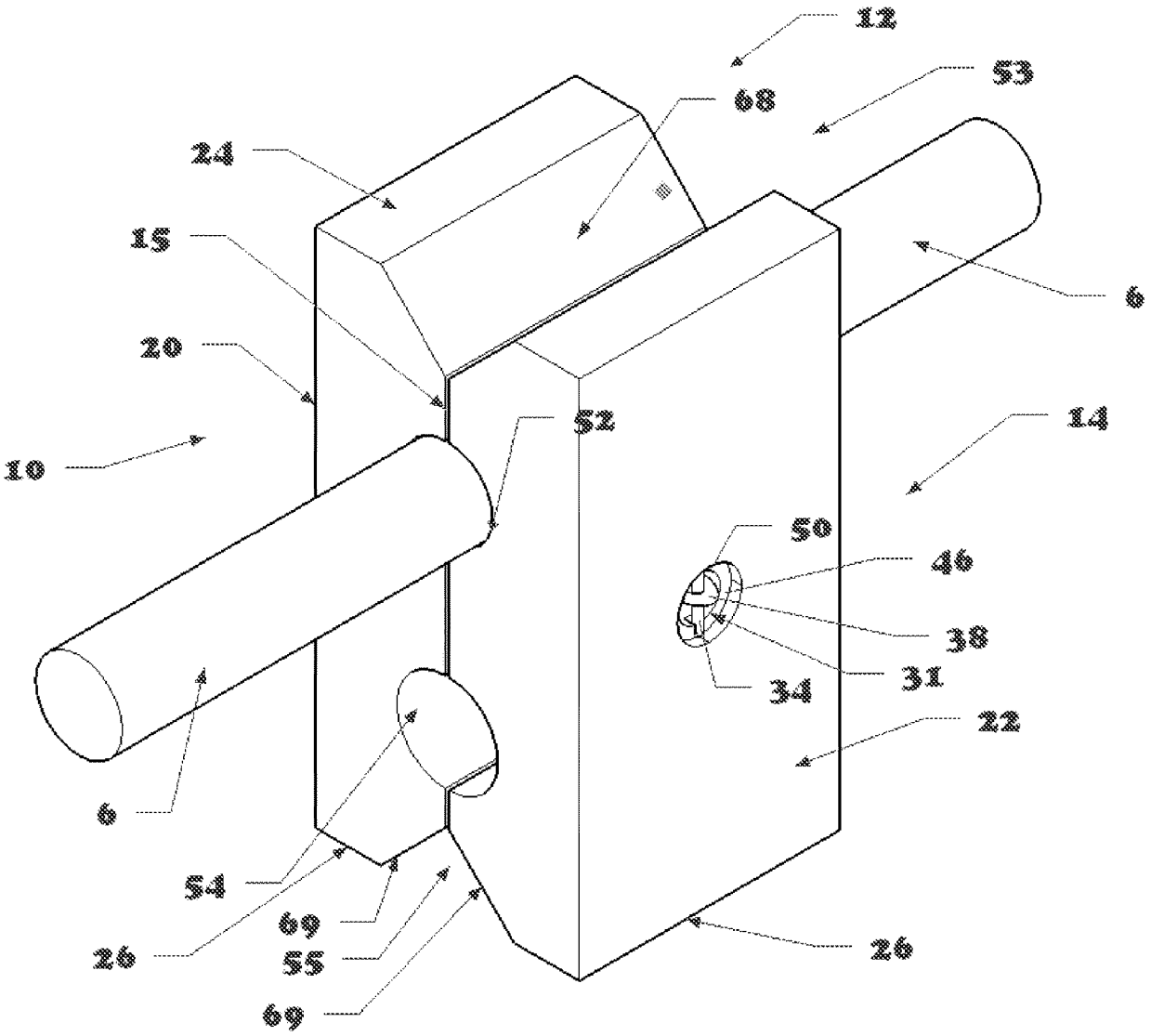
FIG. 3 is a side-top perspective view of the frame block clamp of FIG. 1, but with the frame block clamp vertically orientated for insertion into a vise, and a tube inserted in a selected aperture through the frame block clamp in accordance with the present invention.
Figure 4:
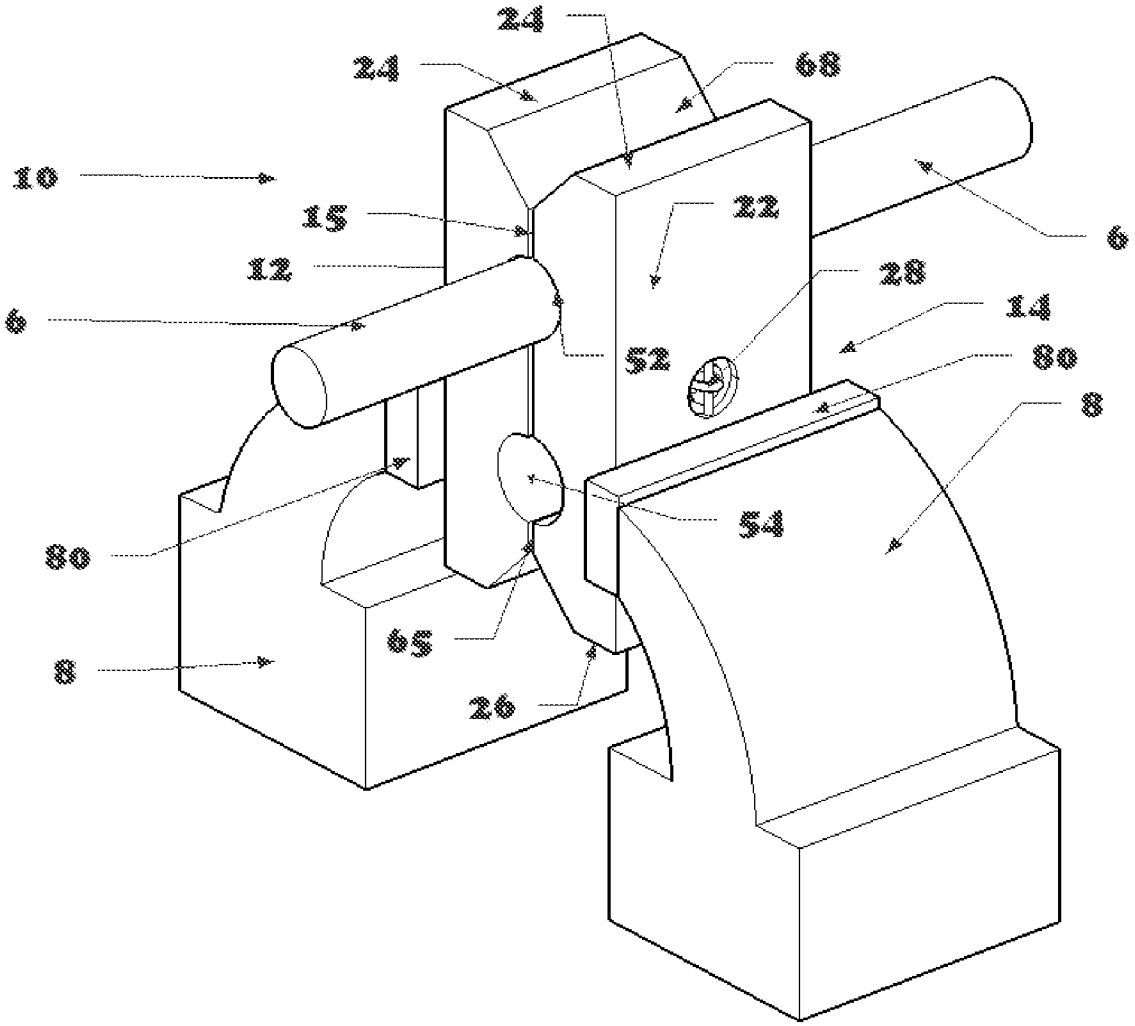
FIG. 4 is the frame block clamp of FIG. 3 secured in a vise.

Referring to the figures, a frame block clamp in accordance with the present invention is denoted as numeral 10. The clamp 10 can be fabricated from a myriad of materials, but the preferred material of construction is a hardwood such as oak or maple to prevent the scratching or marring of the outer wall of a tube 6 or other cylindrically configured object or structure 6 forcibly held by the clamp 10 before and after the clamp 10 is forcibly secured in a vise 8 or similar holding devise.

The clamp 10 includes two identical first and second block portions 12 and 14 dimensioned and configured such that when the block portions 12 and 14 are cooperatively joined, the resulting clamp 10 configuration includes a front wall 16, back wall 18, top wall 20, bottom wall 22 first side wall 24 and second side wall 26 with all walls being substantially planar. The clamp 10 further includes a retaining spring 28 inserted through a first spring aperture 30 in the first block portion 12 and through an axially aligned second spring aperture 31 in the second block portion 14, thereby allowing the retaining spring 28 to extend from the top wall 20 of the first block portion 12 to the bottom wall 22 of the second block portion 14. The position of the retaining spring 28 relative to the first and second block portions 12 is maintained via first and second spring retaining rods 32 and 34 inserted through respective first and second retaining loop portions 36 and 38 of the retaining spring 28.

After inserting the spring retaining rods 32 and 34 through the first and second retaining loop portions 36 and 38, the retaining rods 32 and 34 are snugly inserted into first and second rod receiving recesses 40 and 42 disposed in respective first and second bottom annular walls 44 and 46 formed by cylindrical top and bottom recesses 48 and 50 in respective top and bottom walls 20 and 22, such that the top and bottom recesses 48 and 50 are circumferentially disposed about respective first and second spring apertures 30 and 31. The depth of the bottom annular walls 44 and 46, and the first and second spring apertures 30 and 31 below respective top and bottom walls 20 and 22, together with the axial length of the retaining spring 28 determines the biasing force generated by retaining spring 28 when forcibly extended via the first and second retaining loop portions 36 and 38.

The retaining spring 28 is a tension spring of a type that is well known to those of ordinary skill in the art. The retaining spring 28 includes a free length that causes the spring 28 to exert sufficient pressure on the first and second block portions 12 and 14 to hold the block portions together. This tension is transferred to the first and second block portions 12 and 14 by the retaining loop portions 26 and 38 of the retaining spring 28 interacting with the spring retaining rods 32 and 34. Since the first and second block portions 12 and 14 are held together only by the retaining spring 28, the holding bias generated by the retaining spring 28 upon the first and second block portions 12 and 14 can be increased or decreased by selecting a spring of a different stiffness or free length. The holding bias generated by the retaining spring 28 urges the first and second block portions 12 and 14 together to grasp a preselected tube and maintain the position of the preselected tube relative to the first and second block portions 12 and 14.

Referring to FIGS. 1, 2, 5 and 11, the clamp 10 further includes first and second tube receiving apertures 52 and 54 having different diameters and extending from the front wall 16 to the back wall 18; a first "V" configured recess 53 in the first side wall 32; and a second "V" configured recess 55 in the second side wall 34. Although V configured recesses 53 and 55 are preferred, alternative configurations including but not limited to a "U" configuration can be used. The first and second tube receiving apertures 52 and 54 are formed by machining two respective semi-circle grooves 57 and 59 in first and second inner portions 56 and 58 of respective first and second block portions 12 and 14, such that identically configured semi-circles congruently align when first and second inner planar walls 60 and 62 of respective first and second block portions 12 and 14 are congruently engaged. The first V configured recess 53 and the first tube receiving aperture 52 cooperate to form a first fulcrum 63 for promoting the separation of the first and second inner planar walls 60 and 62 at the second tube receiving aperture 54 when top and bottom walls 20 and 22 at a first side portion 70 of the clamp 10 are manually squeezed such that the obtuse angle 66 formed by first inclined side walls 68 is reduced. The second V configured recess 55 and the second tube receiving aperture 54 cooperate to form a second fulcrum 65 for promoting the separation of the first and second inner planar walls 60 and 62 at the first tube 6 receiving aperture 52 when top and bottom walls 20 and 22 at a second side portion 72 of the clamp 10 are manually squeezed such that the obtuse angle 71 formed by second inclined side walls 69 is reduced.

The clamp 10 ultimately inserts into a vise 8 such that a tube or other structure 6 that is secured to the clamp 10 remains stationary and is not damaged by the vise 8. The fulcrums 63 and 65 are disposed adjacent to a respective recess 53 and 55 in a respective side wall 24 and 26 of the clamp 10. Either side wall 24 and 26 of the clamp 10 can be inserted into a vise 8 such that the vise 8 engages top and bottom walls 20 and 22 of the clamp 10 at portions longitudinally proximate to a respective fulcrum 63 and 65, thereby lineally aligning each "jaw" 80 of the vise 8 with the respective fulcrum 63 and 65. The top and bottom walls 20 and 22 portions of the clamp 10 engaged by the vise jaws 80 allow the vise 8 to grasp the clamp 10 such that the corresponding side portion 24 and 26 of the clamp 10 cannot pivot or otherwise move, thereby maintaining the position of the clamp 10 and the structure 6 secured to the clamp 10 when the jaws 80 of the vise 8 engage the clamp 10.

Figure 5:
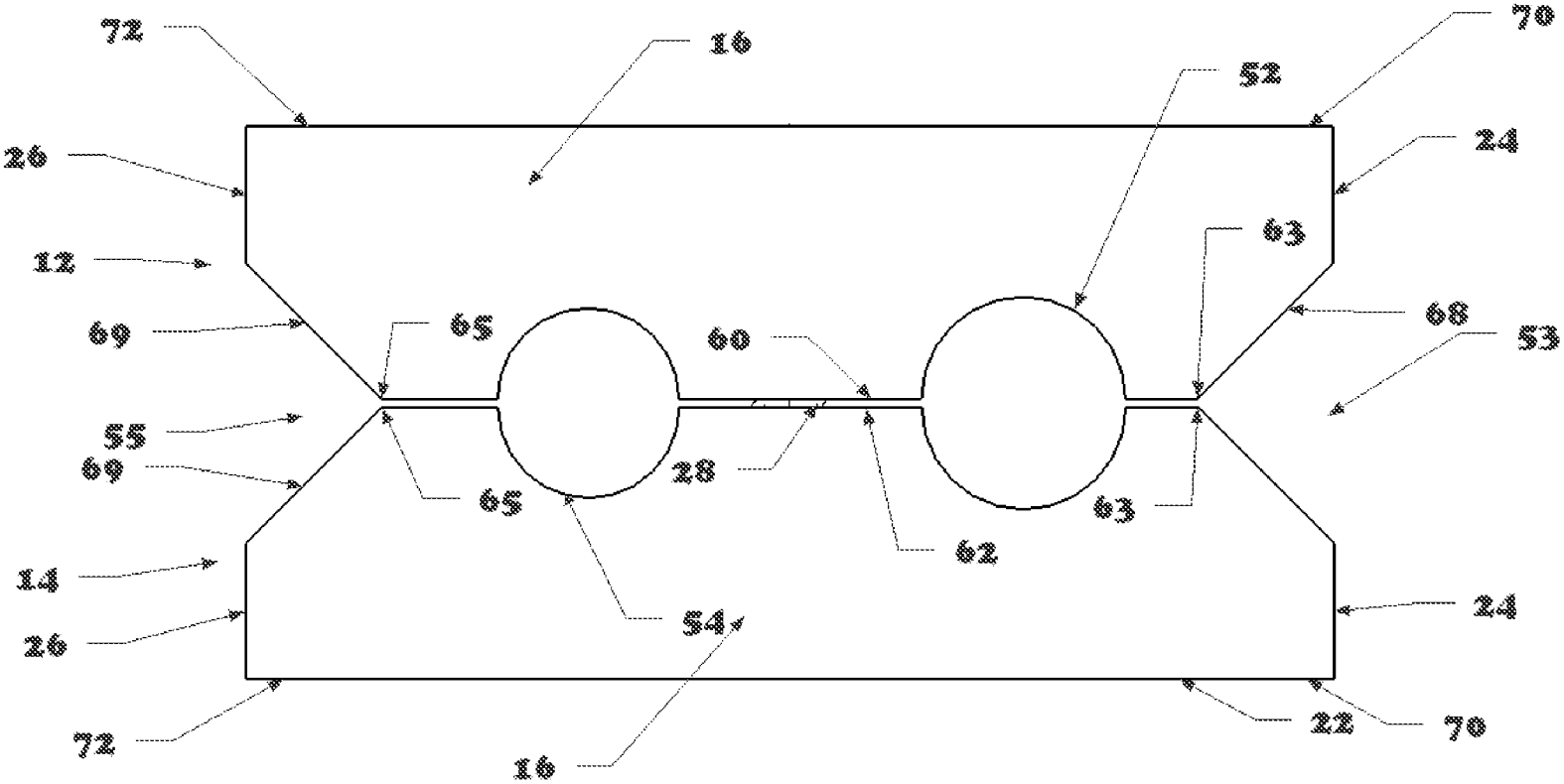
FIG. 5 is a front elevation view of the frame block clamp of FIG. 1.
Figure 5A:
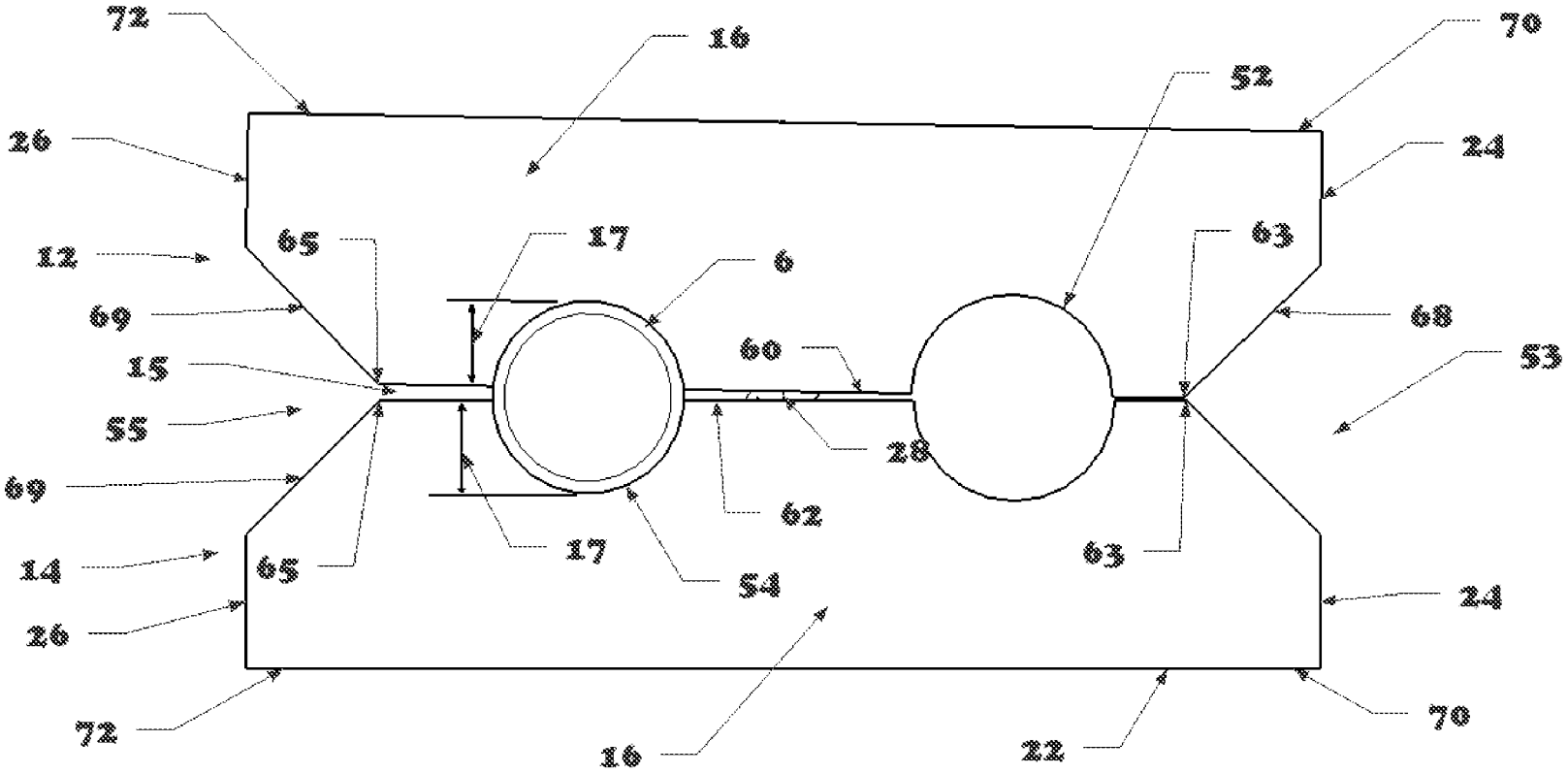
FIG. 5A is the front elevation view of FIG. 5, but with a tube member retained in a left aperture.
Figure 6:
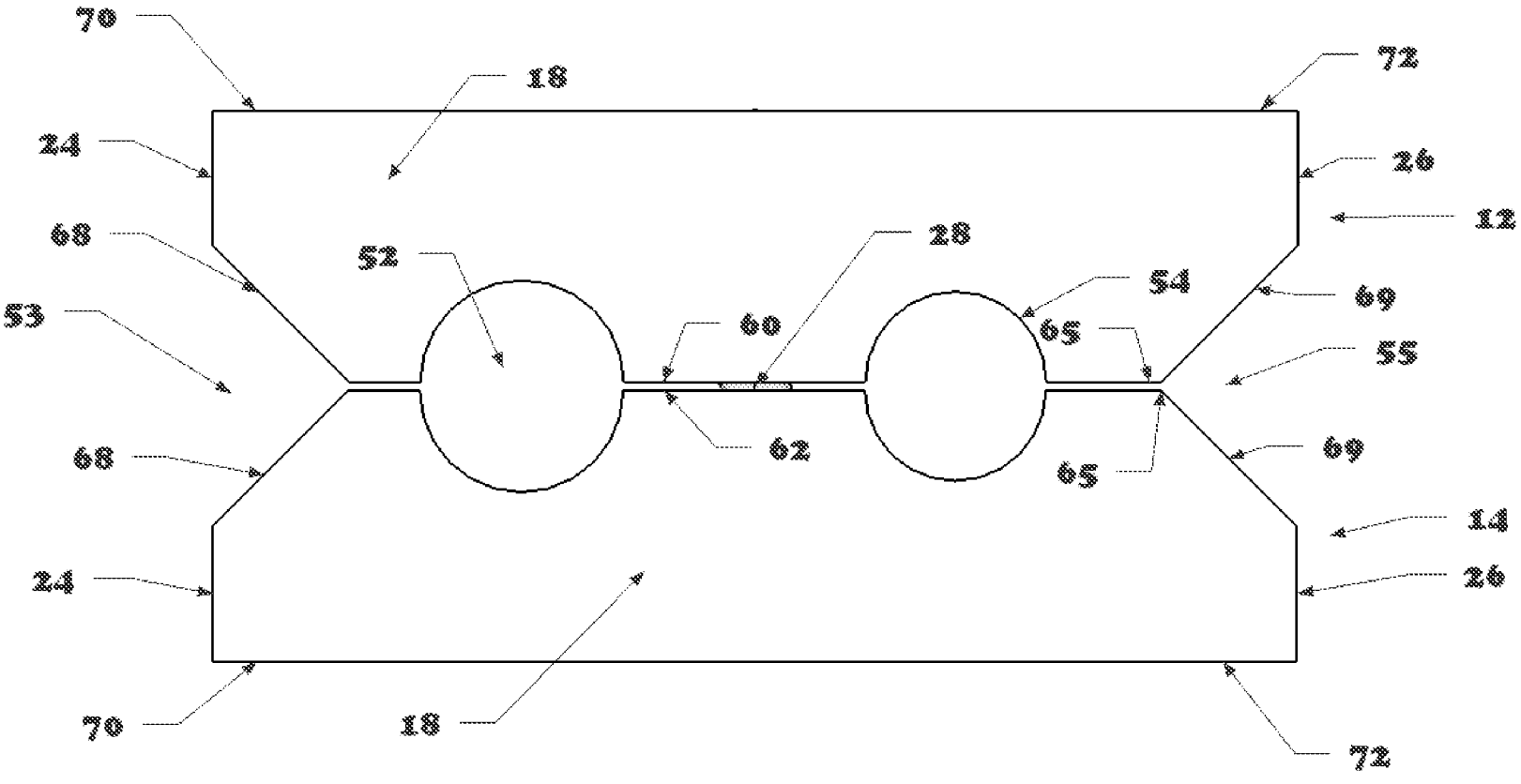
FIG. 6 is a back elevation view of the frame block clamp of FIG. 5.
Figure 7:
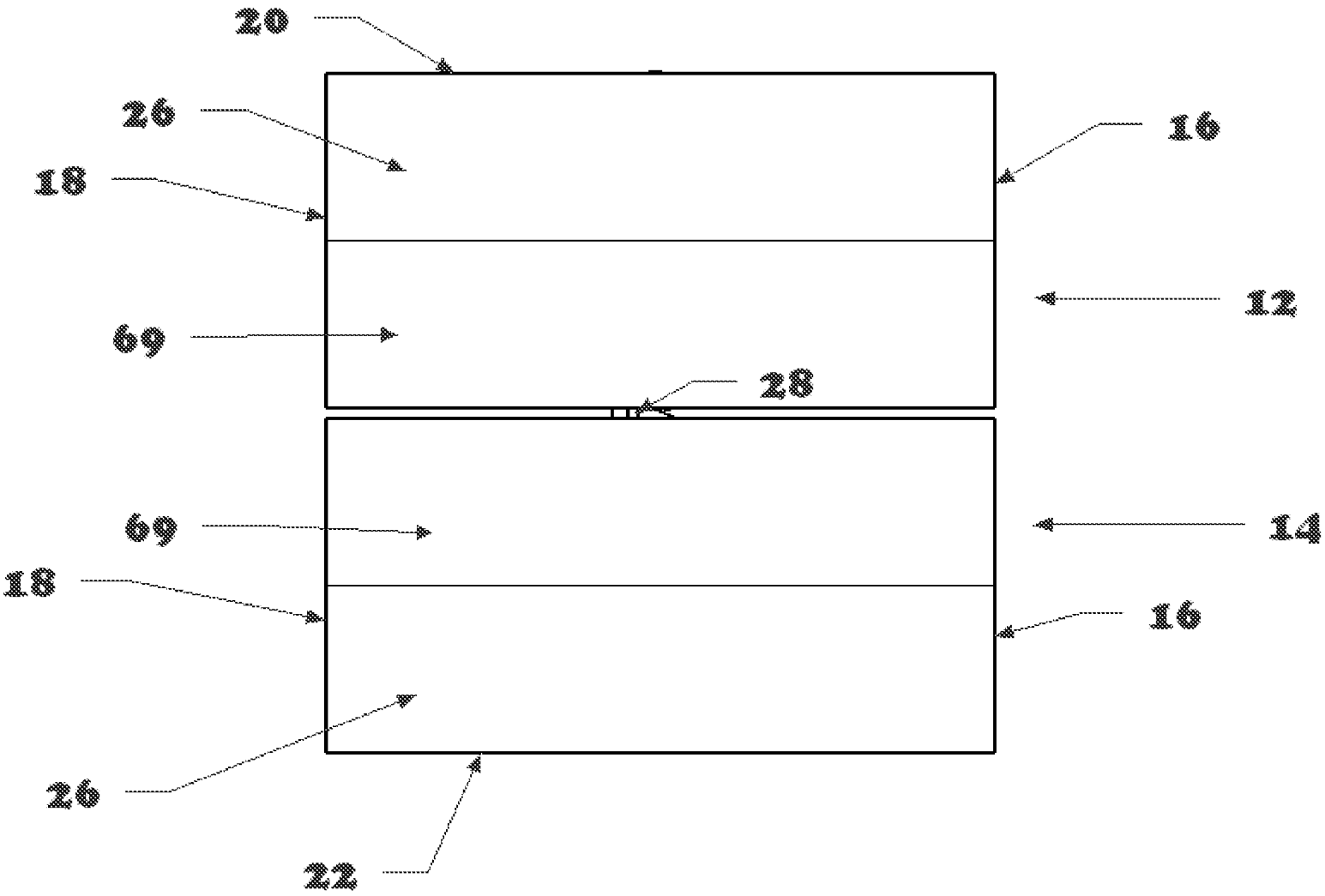
FIG. 7 is a left side elevation view of the frame block clamp of FIG. 1.
Figure 8:
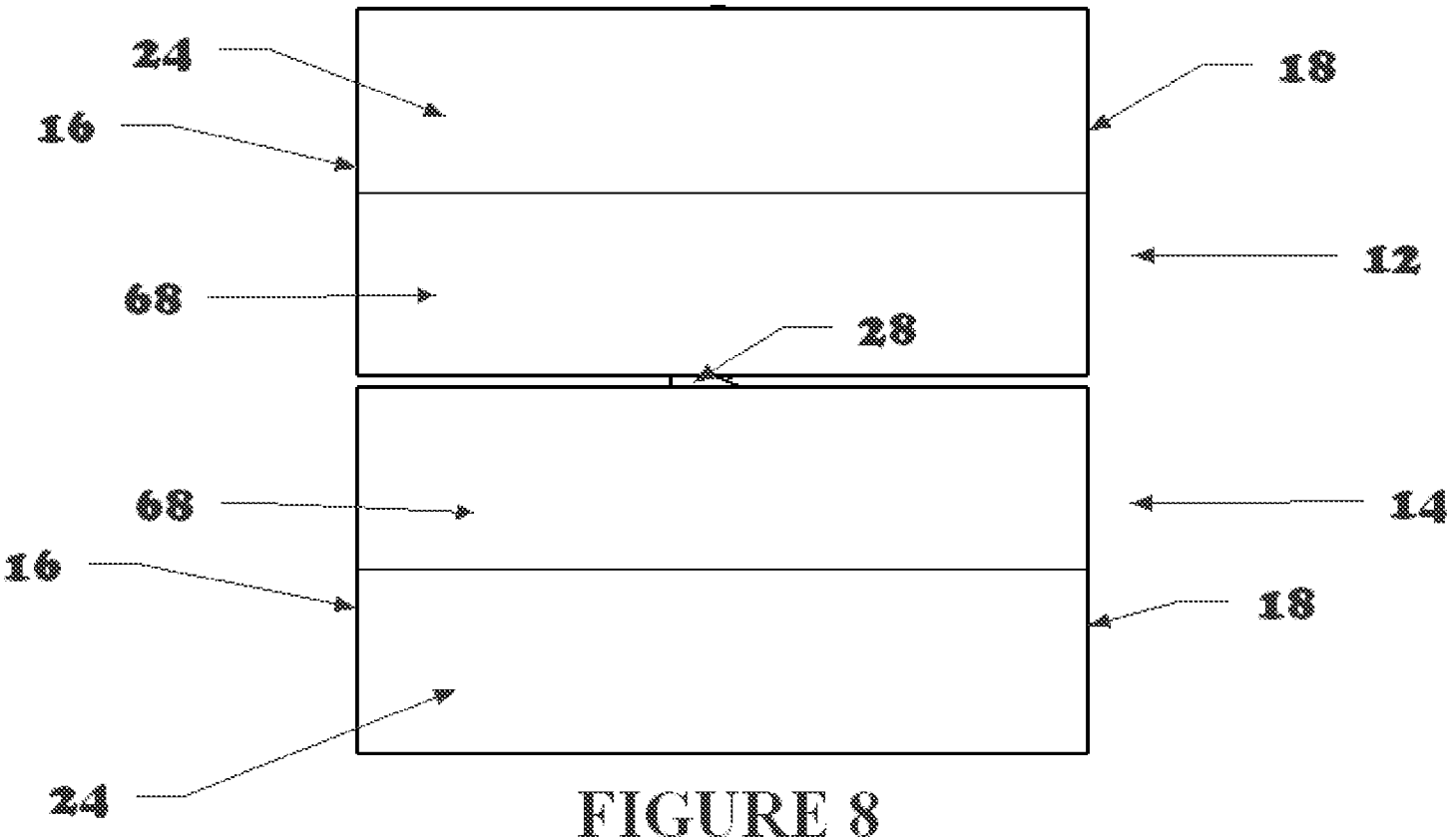
FIG. 8 is a right side elevation view of the frame block clamp of FIG. 7.
Figure 9:
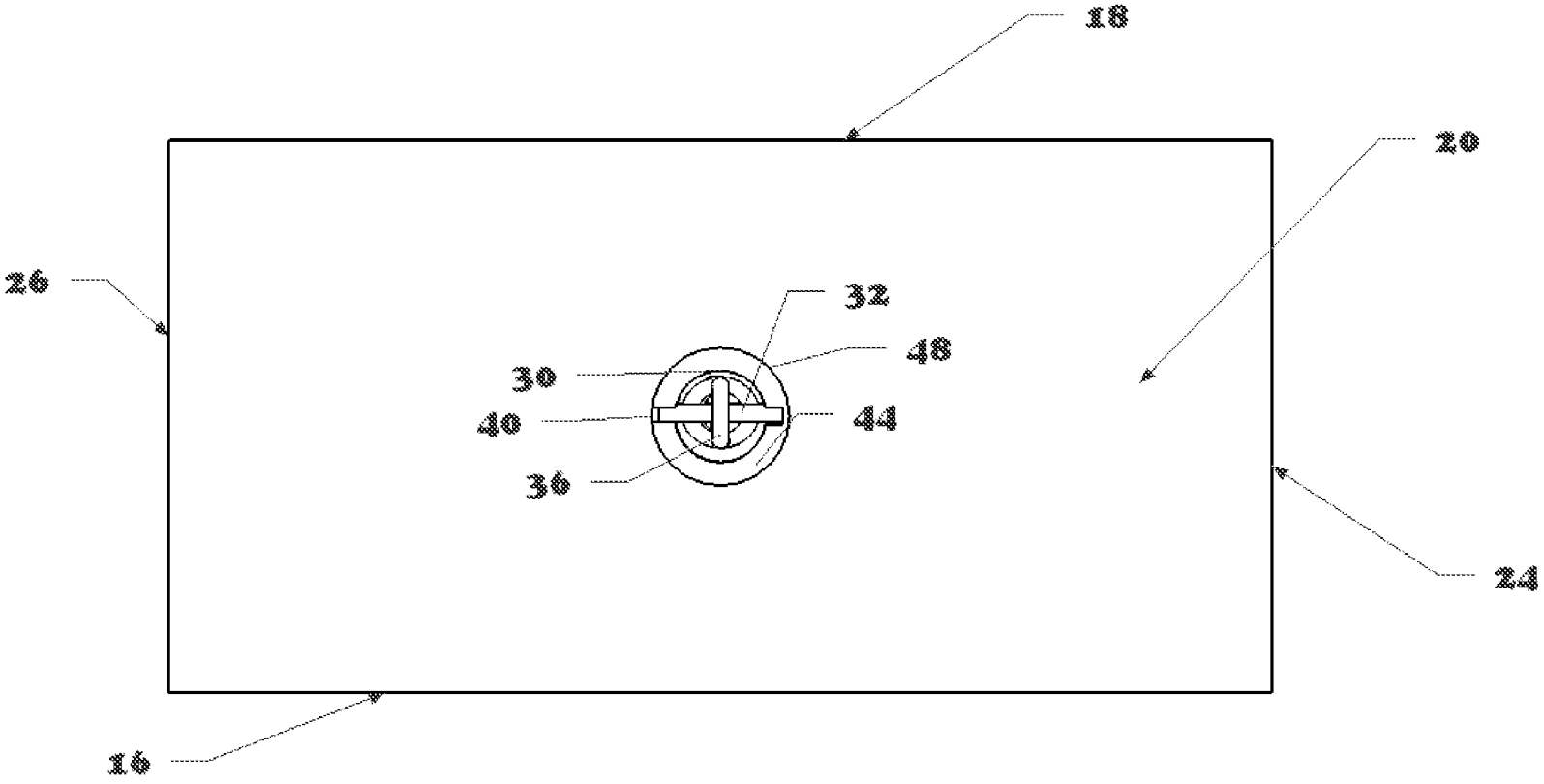
FIG. 9 is a top elevation view of the frame block clamp of FIG. 1.
Figure 10:
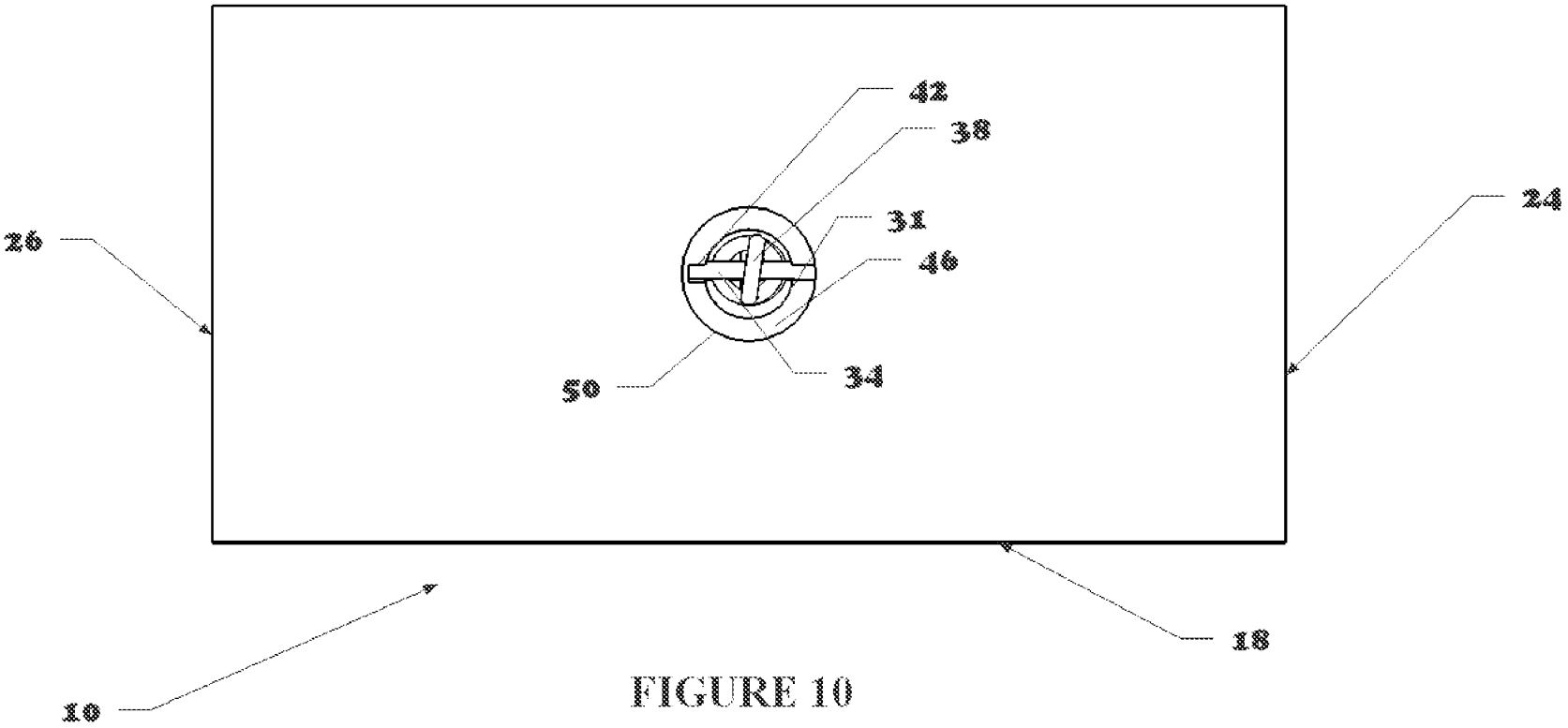
FIG. 10 is a bottom elevation view of the frame block clamp of FIG. 9.
Figure 11:
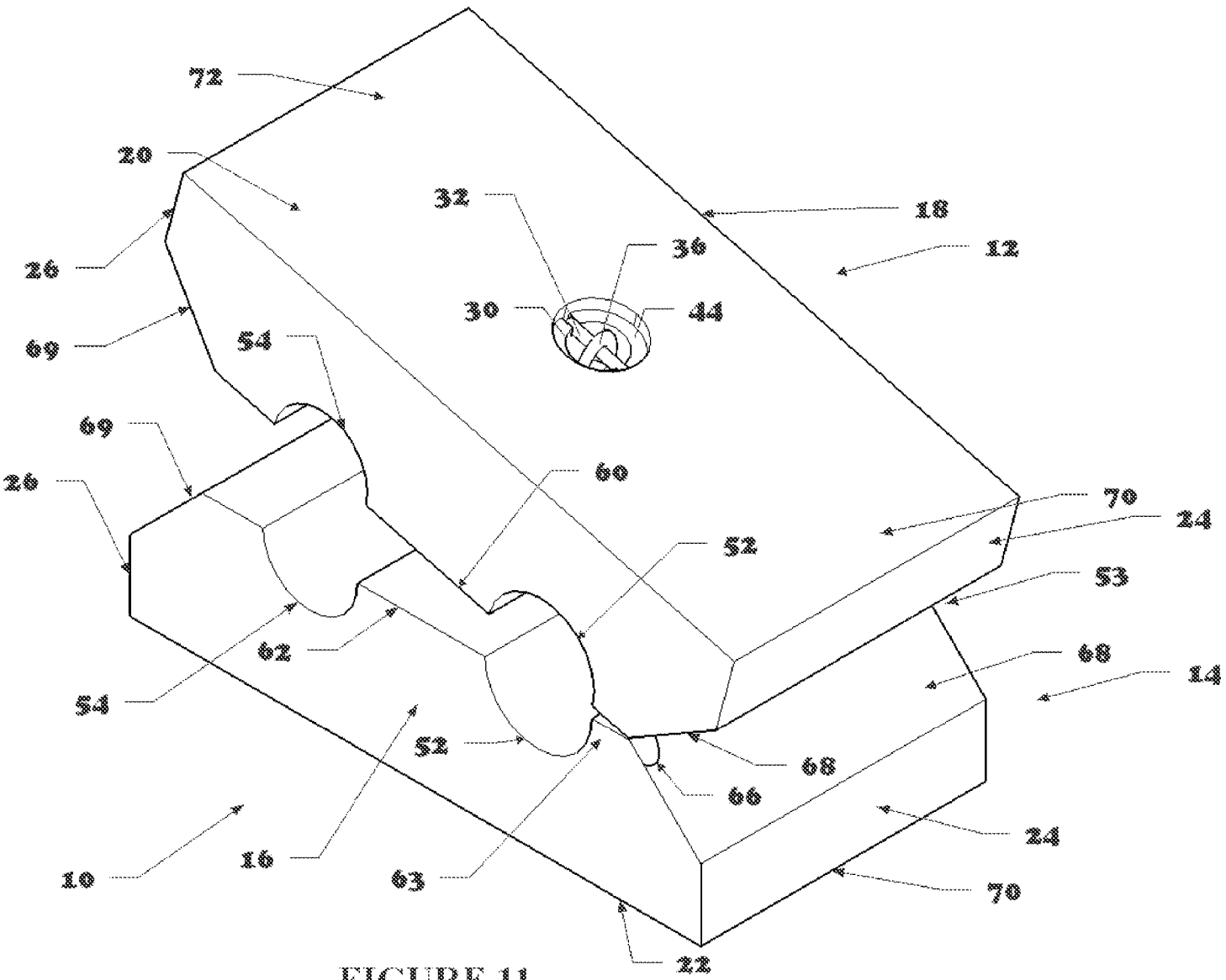
FIG. 11 is the front-top perspective view of FIG. 1, but with the first and second block portions pivoted via a first fulcrum to allow a tube to be inserted into a second tube receiving aperture in accordance with the present invention.

The first and second tube receiving apertures 52 and 54 are each sized to snugly receive respective tubes with predetermined outer diameters. The radius of curvature of each groove 57 and 59 in the first and second block portions 12 and 14 is the same as the outer radius of tubes 6 to be inserted in a respective receiving aperture 52 and 54 formed by the grooves 57 and 59, except that the "depth" (illustrated by arrows 17 in FIG. 5A) of each of the grooves 57 and 59 is slightly less than one-half of the outer diameters of tubes 6 selected to insert into an aperture 52 and 54. The dimensional relationship between the grooves 57 and 59, and tubes 6 to be inserted in the grooves, allows each aperture 52 and 54 to engage a predetermined portion of the periphery of the tube 6, the engaged peripheral portion of the tube 6 corresponding to the depth of each groove 57 and 59; allows a portion of the tube 6 to completely engage a respective groove 57 and 59; and separates first and second inner planar walls 60 and 62 of the first and second block portions 12 and 14, thereby forming a gap 15 (see FIG. 5A) adjacent to the tube 6 in the second aperture 54 when one tube 6 is secured in the clamp 10, resulting in the first and second block portions 12 and 14 substantially encasing the circumferential periphery of tube 6 inserted in the aperture 54 and forcibly squeezing (via the retaining spring 28) the tube 6 between the first and second block portions 12 and 14.

When one tube 6 is secured via the second aperture 54, the first and second inner planar walls 60 and 62 engage at the first fulcrum 63 adjacent to the first V configured recess 53. The encasing of the tubes 6 via the first and second block portions 12 and 14 coupled with the biasing force generated by the retaining spring 28 urging the block portions 12 and 14 together, forcibly "squeeze" the tube 6 between the blocks 12 and 14 with sufficient force to maintain the tubes within the apertures 52 and 54 without damaging the tube 6, and without allowing the tube to slide or rotate peripherally relative to the clamp 10.

Maintaining a tube 6 between the block portions 12 and 14 promotes the insertion of one of the side portions 70 and 72 of the clamp 10 most distal to the secured tube into a vise 8 while the user holds the clamp 10 or the secured tubular structure with one hand and operates the vise 8 with his or her opposite hand to ultimately secure the clamp 10 in the vise 8. The slight separation of the two clamp portions 12 and 14 that exists with a tube placed in one aperture creates a gap 15 having a slight clearance most prominent near the aperture 52 and 54, and side 24 and 26 holding the tube 6. The gap 15 allows the clamping force of the vise 8 to ultimately transfer to the tube 6. Although the configuration of the clamp 10 can include only one aperture or more than two apertures, the preferred configuration of the clamp 10 is to include two apertures that cooperate to allow a side portion 70 and 72 of the clamp 10 to be secured in a vise 8 while the clamp 10 holds one tube or conduit in one of two aperture 52 and 54 most distant to the side portion 70 and 72 inserted in the vise.

The tube or other cylindrical object 6 is ultimately positioned to allow a person to paint or otherwise impart manually labor upon the tube without manually supporting the tube 6, which is held in place by the vise 8. Although the preferred embodiment of the clamp 10 is to provide two cylindrical tube apertures 52 and 54 having different diameters, the clamp 10 could include three or more apertures having a myriad of configurations, including but not limited to square, rectangular, triangular or arucate. Use of triangular grooves 57 and 59 for forming a diamond configured apertures 52 and 54 would accommodate tubes of various thickness including tapered tubes 6.

The first and second "V" configured recesses 53 and 55 are formed by removing portions of side walls 24 and 26 of the first and second block portions 12 and 14, such that the same obtuse angle 66 and 71 is formed between respective first and second inclined side wall 68 and 69 of each block portion 12 and 14. The V configured recesses 53 and 55 enable a user of the frame block clamp 10 to grasp with one hand the top and bottom walls 20 and 22 at one side wall (for example, the first side wall 24) of the clamp 10 that is opposite a preselected tube receiving aperture (for example, the second tube receiving aperture 54) and manually squeeze cooperating inclined side walls 68 together at a first side portion 70 of the clamp 10 until there is sufficient separation of the first and second inner planar walls 60 and 62 at a second side portion 72 at the selected aperture 54 to enable the user to position a tube in the aperture 54 with the user's opposite hand; whereupon, the user releases the first side portion 70 of the clamp 10 being squeezed and the retaining spring 28 urges the first and second block portions 12 and 14 together about the tube, resulting in the maintaining of the position of the tube relative to the first and second block portions 12 and 14 to promote the insertion of the first side portion 70 of the clamp 10 into a vise 8. The same procedure would be used by a user grasping the top and bottom walls 20 and 22 at the second side wall 26 of the clamp 10 that is opposite the first tube receiving aperture 52 of the clamp 10 when a user inserts a tube 6 into the first tube receiving aperture 52.

The foregoing description is for the purpose of illustration only and is not intended to limit the scope of protection accorded this invention. The scope of protection is to be measured by the following claims, which should be interpreted as broadly as the inventive contribution permits.

The invention claimed is:

1. A frame block clamp comprising:

first and second block portions dimensioned and configured to provide first and second tube receiving apertures for snugly receiving a predetermined tube, and said first and second block portions being dimensioned and configured to provide first and second "V" configured recesses in respective first and second side portions when portions of said first and second block portions are cooperatively engaged, said first and second block portions being identical with dimensions and configurations that promote the cooperative joining of the first and second block portions to form a frame block clamp configuration having a front wall, back wall, top wall, bottom wall, first side wall and second side wall with all walls being substantially planar, said first block portion including a first spring aperture and said second block portion including a second spring aperture; and a retaining spring dimensioned and disposed to urge together predetermined portions of said first and second block portions, said first and second spring apertures ultimately being axially aligned for receiving said retaining spring such that said retaining spring is dimensioned with sufficient biasing force to ultimately join said first and second block portions together, to allow said first and second block portions to be manually separated and to urge said first and second block portions together when the manual separation force is removed with sufficient biasing force to maintain a tube positioned in one of said tube receiving apertures, whereby, said V configured recesses enable a user of said frame block clamp to grasp with one hand top and bottom walls of said clamp proximate to one side wall of said clamp that is opposite a preselected tube receiving aperture, and manually urge cooperating inclined side walls together at a first side portion of said clamp until there is sufficient separation of first and second inner planar walls at a second side portion of said clamp to enable the user to position a tube in said preselected aperture with the user's opposite hand said retaining spring including first and second retaining loop portions for removably receiving retaining spring rods that snugly insert into first and second rod receiving recesses disposed in respective first and second bottom annular walls formed by cylindrical top and bottom recesses in respective top and bottom walls of said frame block clamp, such that said top and bottom recesses are circumferentially disposed about respective first and second spring apertures; whereupon, the user releases said first side portion of said clamp thereby causing said retaining spring to urge said first and second block portions into engagement with the tube, resulting in the maintaining of the position of the tube relative to said first and second block portions to promote the insertion of said first side portion of said clamp into a vise.

2. The frame block clamp of claim 1 wherein said first and second tube receiving apertures have different diameters and extend from said front wall to said back wall of said frame block clamp, said first and second tube receiving apertures being formed by machining two semi-circle grooves in first and second inner portion of said first and second block portions such that identically configured semi-circles congruently align when first and second inner planar walls of respective first and second block portions are congruently engaged.

3. The frame block clamp of claim 2 wherein said first and second tube receiving apertures include a radius of curvature equal to the outer radius of tubes to be inserted in said receiving apertures, said first and second receiving apertures having a depth slightly less than one half of the outer diameter of the tube to be inserted into a respective aperture.

4. The frame block clamp of claim 3 wherein said first and second "V" configured recesses are formed by removing portions of side walls of said first and second block portions, such that obtuse angles are formed between first and second inclined side walls of each block portion.

5. The frame block clamp of claim 4 wherein said "V" configured recesses enable a user of said frame block clamp to grasp with one hand said top and bottom walls at one side wall of said clamp that is opposite a preselected tube receiving aperture and manually squeeze cooperating inclined side walls together at a first side portion of said clamp until said first and second inner planar walls sufficiently separate from a first side portion fulcrum to a second side portion adjacent to said selected aperture to enable the user to position a tube in said selected aperture with the user's opposite hand; whereupon, the user releases said first side portion of said clamp being squeezed thereby enabling said retaining spring to urge said first and second block portions together about the tube, resulting in the maintaining of the position of the tube relative to said first and second block portions to promote the insertion of said first side portion of said clamp into a vise.

6. A clamp comprising:

first and second block portions dimensioned and configured to provide at least one receiving aperture for snugly receiving and maintaining the position of a preselected structure relative to said clamp, said first and second block portions being dimensioned and configured to provide at least one recess in a respective side portion when portions of said first and second block portions are cooperatively engaged, said first and second block portions include substantially similar dimensions and configurations that promote the cooperative joining of the first and second block portions to form a clamp configuration having a front wall, back wall, top wall, bottom wall, first side wall and second side wall with all walls being substantially planar, said first block portion including a first spring aperture and said second block portion including a second spring aperture; and a retaining spring dimensioned and disposed to urge together predetermined portions of said first and second block portions, said first and second spring apertures ultimately being axially aligned for receiving said retaining spring such that said retaining spring is dimensioned with sufficient biasing force to ultimately join said first and second block portions together, to allow said first and second block portions to be manually separated and to urge said first and second block portions together when the manual separation force is removed with sufficient biasing force to maintain the preselected structure in said at least one receiving aperture, said recess in a respective side portion cooperates with said retaining spring to enable a selected one of said first and second side portions of said clamp to pivot upon a respective fulcrum, thereby urging together inclined side walls of said selected one of said first and second side portions and correspondingly urging apart inclined side walls opposite said selected one of said first and second side portions, said retaining spring including first and second retaining loop portions for removably receiving retaining spring rods that snugly insert into first and second rod receiving recesses disposed in respective first and second bottom annular walls formed by cylindrical top and bottom recesses in respective top and bottom walls of said frame block clamp, such that said top and bottom recesses are circumferentially disposed about respective first and second spring apertures; whereupon, the preselected structure is inserted in said receiving aperture and all inclined side walls are returned to their respective positions before pivoting said selected one of said first and second side portions, resulting in the grasping and securing of the preselected structure to said clamp, thereby allowing an opposite side portion of said clamp relative to said selected one of said first and second side portions of said clamp to be inserted into a vise to allow a user of the clamp to perform work upon the preselected structure.

7. The clamp of claim 6 wherein first and second receiving apertures are included, said first and second receiving apertures having different dimensions and extend from said front wall to said back wall of said clamp, said first and second receiving apertures being formed by machining two grooves in first and second inner portions of said first and second block portions such that identically configured and congruently aligned apertures are formed when first and second inner planar walls of respective first and second block portions are congruently engaged.

8. The clamp of claim 7 wherein said first and second receiving apertures are each sized to snugly receive respective preselected structures with predetermined outer dimensions that are relatively larger than a respective inner dimension of said first and second apertures, thereby separating first and second inner planar walls of said first and second block portions at a selected aperture when a preselected structure is inserted in said selected aperture, resulting in the forcible "squeezing" and the holding of the preselected structure between said first and second block portions via said retaining spring's bias urging said block portions together, thereby promoting the insertion of a side portion of said clamp opposite the secured preselected structure into a vise while the user holds said clamp with one hand and operates the vise with his or her opposite hand to ultimately secure said clamp in the vise while the preselected structure is secured in said clamp.

9. The clamp of claim 8 wherein said first and second recesses include a "V" configuration formed by removing portions of side walls of said first and second block portions, such that obtuse angles are formed between first and second inclined side walls of each block portion.

10. The clamp of claim 9 wherein said "V" configured recesses enable a user of said clamp to grasp with one hand said top and bottom walls at one side wall of said clamp that is opposite a selected receiving aperture and manually squeeze cooperating inclined side walls together until said first and second inner planar walls sufficiently separate from a respective side portion fulcrum to an opposite side portion adjacent to said selected aperture to enable the user to position a preselected structure in said selected aperture with the user's opposite hand; whereupon, the user releases said first side portion of said clamp being squeezed thereby enabling said retaining spring to urge said first and second block portions together about the selected structure, resulting in the maintaining of the position of the selected structure relative to said first and second block portions to promote the insertion of a selected side portion of said clamp into a vise.

11. A spring biased clamp comprising:

first and second block portions dimensioned and configured to provide a receiving aperture for snugly receiving and maintaining the position of a preselected structure relative to said clamp, said first and second block portions being dimensioned and configured to provide recesses in respective side portions when portions of said first and second block portions are cooperatively engaged, said recesses include a "V" configuration formed by removing portions of side walls of said first and second block portions, such that obtuse angles are formed between first and second inclined side walls of each sidewall of each block portion, said first block portion including a first spring aperture and said second block portion including a second spring aperture, said first and second spring apertures ultimately being axially aligned for receiving said retaining spring such that said retaining spring is dimensioned with sufficient biasing force to ultimately join said first and second block portions together and to allow said first and second block portions to be manually separated and to urge said first and second block portions together, when the manual separation force is removed, with sufficient biasing force to maintain the preselected structure in said receiving aperture; and a retaining spring dimensioned and disposed to urge together predetermined portions of said first and second block portions, said retaining spring including first and second retaining loop portions for removably receiving retaining spring rods that snugly insert into first and second rod receiving recesses disposed in respective first and second bottom annular walls formed by cylindrical top and bottom recesses in respective top and bottom walls of said clamp, such that said top and bottom recesses are circumferentially disposed about respective first and second spring apertures, said recess in a respective side portion cooperates with said retaining spring to enable a selected one of said first and second side portions of said clamp to pivot upon a respective fulcrum, thereby urging together inclined side walls of said selected one of said first and second side portions and correspondingly urging apart inclined side walls opposite said selected one of said first and second side portions; whereupon, the preselected structure is inserted in said receiving aperture and all inclined side walls are returned to their respective positions before pivoting said selected one of said first and second side portions, resulting in the grasping and securing of the preselected structure to said clamp, thereby allowing an opposite side portion of said clamp relative to said selected one of said first and second side portions of said clamp to be inserted into a vise to allow a user of the clamp to perform work upon the preselected structure.

12. The clamp of claim 11 wherein said first and second block portions include a longitudinal dimension that positions said fulcrums adjacent to respective receiving recesses in each side portion of said clamp, thereby promoting the insertion of either side portion of said clamp into a vise such that the vise jaws engage top and bottom walls of said clamp at portions longitudinally proximate to a respective fulcrum, resulting in the lineally aligning of each vise jaw with a respective fulcrum to avoid damaging the tube retained in a respective receiving aperture.

13. The clamp of claim 12 wherein said engaged top and bottom walls by the vise jaws prevent a respective side portion of said clamp from moving, thereby maintaining the position of said clamp in the vise and maintaining the position of the tube in said clamp, resulting in a user being able to perform work on the tube.

14. The clamp of claim 11 wherein each of said receiving apertures include predetermined diameters dimensioned slightly less than one-half of a respective outer diameter of a tube selected for insertion into a respective receiving aperture, thereby forming a gap between said first and second block portions, resulting in said first and second block portions substantially encasing the periphery of a tube inserted in a respective receiving aperture, and forcibly squeezing a respective tube between said first and second block portions via a biasing force generated by said retaining spring to maintain a tube in said respective receiving aperture without damaging the tube and without allowing the tube to slide longitudinally or rotate peripherally relative to said first and second block portions.

* * * * *